United States Patent [19]

Jamrozy et al.

[11] Patent Number: 4,862,810

[45] **Date of Patent: * Sep. 5, 1989**

[54] RAILROAD CAR FOR CONTAINER TRANSPORT

[75] Inventors: Richard E. Jamrozy, Lansing, Ill.; James M. Wilczynski, Highland, Ind.

[73] Assignee: Thrall Car Manufacturing Co., Chicago Heights, Ill.

[ * ] Notice: The portion of the term of this patent subsequent to Feb. 28, 2006 has been disclaimed.

[21] Appl. No.: 219,480

[22] Filed: Jul. 15, 1988

Related U.S. Application Data

[63] Continuation of Ser. No. 74,341, Jul. 16, 1987, Pat. No. 4,807,722, and a continuation-in-part of Ser. No. 890,284, Jul. 29, 1986, Pat. No. 4,771,706.

[51] Int. Cl.[4] ..... B61D 3/20

[52] U.S. Cl. ..... 105/355; 105/404; 105/417; 410/78

[58] Field of Search ..... 105/404, 420, 355, 411, 105/417, 418, 414, 419; 410/44, 78

[56] References Cited

U.S. PATENT DOCUMENTS

| | | | |
|---|---|---|---|
| 1,399,077 | 12/1921 | Posson | 105/420 |
| 3,357,371 | 12/1967 | Gutridge | 410/54 |
| 3,399,631 | 9/1968 | Weber | 105/4 |
| 3,616,764 | 11/1971 | Johnson et al. | 105/414 X |
| 4,091,742 | 5/1978 | Cordani | 105/418 X |
| 4,331,083 | 5/1982 | Landregan et al. | 105/418 X |
| 4,456,413 | 6/1984 | Pavlick | 410/65 X |
| 4,599,949 | 7/1986 | Hill | 105/355 |
| 4,624,188 | 11/1986 | Kaleta | 105/355 |
| 4,686,907 | 8/1987 | Woollam et al. | 105/4.1 |
| 4,771,706 | 9/1988 | Lindauer et al. | 105/419 X |

*Primary Examiner*—Stephen M. Hepperle

*Attorney, Agent, or Firm*—Marshall, O'Toole, Gerstein, Murray & Bicknell

[57] ABSTRACT

A railroad car for transporting horizontal shipping containers includes (1) a vertical transition box from the car center sill to the end wall of a well portion capable of receiving one or more shipping containers, (2) car body bottom side sills in the form of an inverted T-member, (3) shear plates at the bottom ends of the well portion, (4) a longitudinal plate in the car body well portion bottom joined to a shear plate at each end, and (5) reinforcement of the car body central portion so that it can transport two end-to-end abutting containers in the well.

20 Claims, 4 Drawing Sheets

RAILROAD CAR FOR CONTAINER TRANSPORT

This is a continuation of application Ser. No. 074,341 filed July 16, 1987, now U.S. Pat. No. 4,807,722 issued Feb. 28, 1989; and it is also a continuation-in-part of application Ser. No. 890,284, filed July 29, 1986, now U.S. Pat. No. 4,771,706 issued Sept. 20, 1988 the entire contents of which is incorporated herein by reference.

This invention relates to railroad freight cars. More particularly, this invention is concerned with railroad freight cars which transport shipping containers in one or two layers.

BACKGROUND OF THE INVENTION

Freight shipping containers are widely used to transport a variety of goods and products on ships, barges, railroads and over-the-highway vehicles. Container transport is very efficient since it minimizes labor costs, damage to goods and products and reduces the opportunities for pilferage and vandalism.

Containers come in different but standardized lengths. The lengths most widely used are 20, 35, 40, 45 and 48 feet. To the extent possible, the railroad cars which transport containers must be able to accommodate as many different length containers as possible.

One type of container car in use is referred to as a well car since it contains a container receiving well portion or space between car railway trucks at each end. The bottom of the well is generally at about the height of the wheel axles so that when one or more containers are placed in the well they provide a low profile and a low center of gravity. This makes it possible to stack a container on top to form a double stack container load. When containers are double stacked, the total length of the top layer can be the same as or considerably longer than the first layer because the top layer can extend over the ends of the well and partially over the trucks. Representative of such cars are those disclosed in U.S. Pat. Nos. 4,624,188; 4,456,413; 4,091,742; and 3,357,371. Although the railroad cars disclosed in those patents, and the cars now in use, for carrying containers perform reasonably well there is a desire to have even better cars available. It is accordingly a primary purpose of this invention to provide a railroad car having a well portion for carrying shipping containers characterized by structural improvements which make it easy to manufacture, strong and light weight.

SUMMARY OF THE INVENTION

A railroad car for transporting horizontal shipping containers is provided by this invention containing at least one of a plurality of novel structural features disclosed herein. The novel structural features disclosed herein includes at least (1) a vertical transition box from the car center sill to the end wall of a well portion capable of receiving one or more shipping containers, (2) car body bottom side sills in the form of an inverted T-member, (3) shear plates at the bottom ends of the well portion, (4) a longitudinal plate in the car body well portion bottom joined to a shear plate at each end, and (5) reinforcement of the car body central portion so that it can transport two end-to-end abutting containers in the well. These and other novel structural features disclosed herein can be used singly or in any combination to produce a railroad car according to the invention.

In one embodiment of the invention a railroad car for transporting a horizontal shipping container is provided having first and second railroad trucks supporting opposite ends of a railroad car body; the car body having a well portion, defined in part by low longitudinal side walls and lateral end walls, which supports one or more horizontal longitudinally positioned containers; a center sill at each end of the car body; each center sill being joined at one end to an upper portion of an adjacent well end wall with the other end of the center sill having coupler means to couple the car to another car to make up a train; a vertical transition box extending downwardly outside of the well portion along the lateral end wall from the center sill bottom to about the bottom of the well portion; and with the well side walls having top and bottom side sills extending at least for the length of the well portion.

The vertical transition box can be essentially rectangular in lateral section and the center sill can be essentially rectangular in vertical section.

In another embodiment of the invention there is provided a railroad car for transporting a horizontal shipping container comprising first and second railroad trucks supporting opposite ends of a railroad car body; the car body having a well portion, defined in part by low longitudinal side walls and lateral end walls, which supports one or more horizontal longitudinally positioned containers; the well side walls having top and bottom side sills extending at least for the length of the well portion; and each bottom side sill is an inverted T-shaped member and if desired a plurality of lateral cross braces can extend between and be joined to the bottom side sills.

An additional embodiment of the invention comprises a railroad car for transporting a horizontal shipping container having first and second railroad trucks supporting opposite ends of a railroad car body; the car body having a well portion, defined in part by low longitudinal side walls and lateral end walls, which supports one or more horizontal longitudinally positioned containers; the well side walls having top and bottom side sills extending at least for the length of the well portion; and a lateral shear plate at the bottom of and in the well portion along each end wall and connected to each bottom side sill.

The various railroad car embodiments can have each top side sill extend beyond the end of the well portion to the end of the car body; an end sill at each end of the car body joined to the ends of the end sill; and a shear plate positioned on top of and joined to each center sill, end sill, the side sills and the well portion end wall.

One or both of the end sills can have an outer vertical lateral surface and two side bearing arms joined to the end sill vertical surface.

Each well portion end wall can be reinforced with a flanged structural member extending between and joined to the bottom side sills. Also, the top of each well portion end wall can be reinforced with a flanged structural member extending between and joined to the top side sills.

The well portion can be sized to receive and transport two containers positioned to abut end-to-end and an angle member can be positioned in the well portion to nest with and be joined to the corner formed by the web and flange of the inverted T-member, where the adjacent ends of the two containers abut each other. Each well portion side wall can also have a plurality of vertical ribs on the outside of the side wall central of the well length and a second angle member having a horizontal flange can be joined to the bottom of the inverted T-member outer flange and a vertical flange of the second angle member can be joined to at least one vertical rib. A vertical plate can be joined to two centrally located ribs and the plate can extend from and be joined to the top side sill and to the second angle member vertical flange.

To support an upper container on top of one or more containers in the car body well portion each end of the car body can have a vertically projecting bulkhead structure which includes a lateral bulkhead end wall extending the width of the car body and a pair of opposing relatively short bulkhead side walls extending longitudinally inwardly from the bulkhead end wall along the sides of the car body. Each bulkhead side wall of a pair of such walls can have a container restraining member mounted on an axle for rotation about a substantially vertical axis from a stored position, where it does not reduce the clearance between opposing bulkhead side walls, to an operating position where it at least projects laterally inwardly of the bulkhead wall to be positioned adjacent a vertical end corner of a top container.

DETAILED DESCRIPTION OF THE DRAWINGS

To the extent it is reasonable and practical the same or similar elements which appear in the various views of the drawings will be identified by the same numbers.

Figure 1:
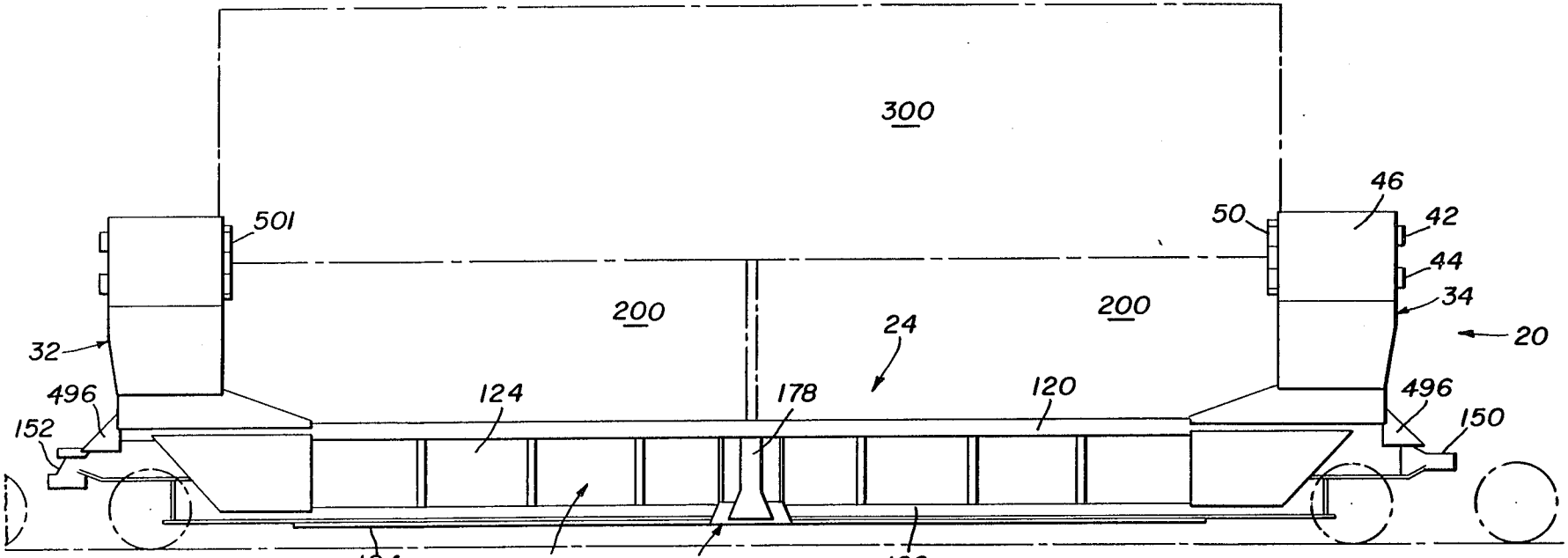
FIG. 1 is a side elevational view of one embodiment of a railroad car, according to the invention, for transporting horizontal double stacked shipping containers, shown in phantom.
Figure 2:
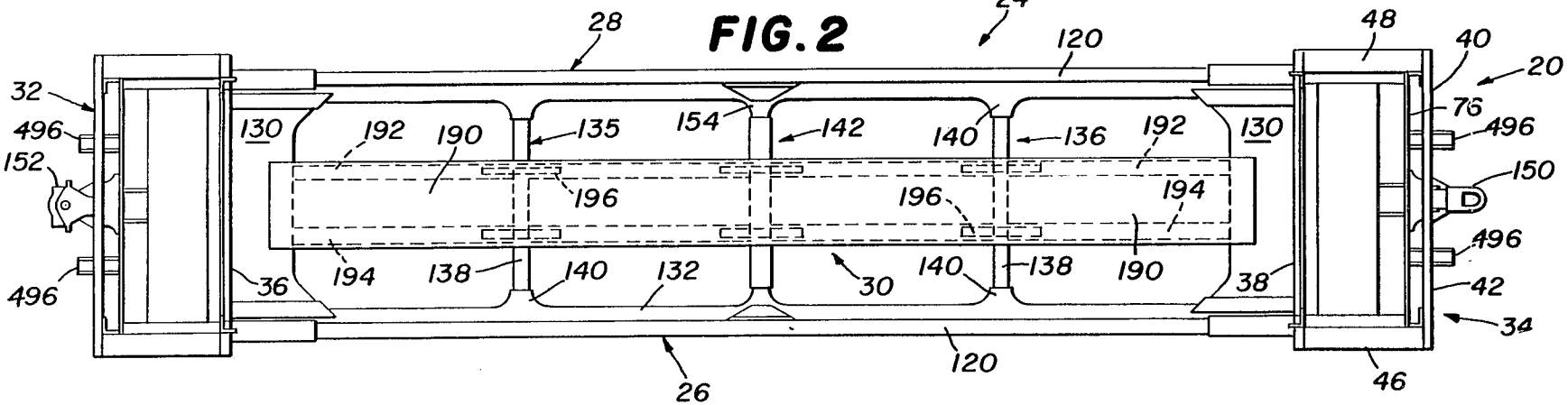
FIG. 2 is a plan view of the railroad car shown in FIG. 1.

The railroad car 20 for transporting horizontal double stacked shipping containers shown in FIGS. 1 and 2 has a body 24 comprising a pair of opposing longitudinal low vertical side walls 26, 28, a bottom or floor 30 and a vertically projecting bulkhead structure 32, 34 at each end of the car body. Each end of the car body is supported by a railroad car truck which may support only one car end or the car truck can support two adjacent car ends by means of an articulated coupling, such as shown in U.S. Pat. No. 3,646,604. The car shown in the drawings is provided with a male coupler portion 150 at one end and a female coupler portion 152 at the other end which on opposing ends of adjacent cars unite to form an articulated coupling.

The lower portion of each bulkhead structure 32, 34 includes a respective vertical lateral end wall 36, 38 extending between the body side walls 26, 28. The well space defined by the two end walls 36, 38 and the two side walls 26, 28 is dimensioned to hold one forty-feet long lower or bottom container or two twenty-feet long containers.

Each vertically projecting bulkhead structure 32, 34 is essentially a mirror image of the other so only one will be described in detail. However, the same or similar parts on each of the two bulkhead structures have the same numbers for convenience and easy reference.

The bulkhead structure 34 (FIGS. 1 to 3) includes a lateral bulkhead end wall 40 comprising two horizontal spaced apart channel members 42, 44 which extend the width of the car body. Also, the bulkhead structure 34 has a pair of opposing relatively short bulkhead side walls 46, 48 extending longitudinally inwardly from the bulkhead end wall 40 and which are substantially aligned with the well side walls 26, 28. Each bulkhead side wall 46, 48 is essentially a mirror image of the other wall.

Because the top or upper container 300 placed on one or more lower containers 200 can have a length equal to the combined length of the lower container(s), i.e. forty-feet, or be a longer standard length, i.e. forty-five or forty-eight feet (FIG. 1) retractable means is provided to keep the shorter forty and forty-five feet containers from moving longitudinally during transport since they would not be directly restrained by contact with the end walls 40, which are forty-eight feet apart, as would the largest or forty-eight feet long container. Accordingly, each bulkhead structure can be provided with retractable means which can be moved from an operable position, which restrains upper container ends, to a stored position where they do not obstruct positioning a longer container between the bulkhead side walls.

As shown in FIG. 1, bulkhead side wall 48 has a retractable container restraining member 50 and bulkhead side wall 46 has a retractable container restraining member 501 which is a mirror image of member 50. Kaleta et al U.S. Pat. 4,624,188 discloses one such type of restraining apparatus which can be used in this railroad car.

Figure 3:
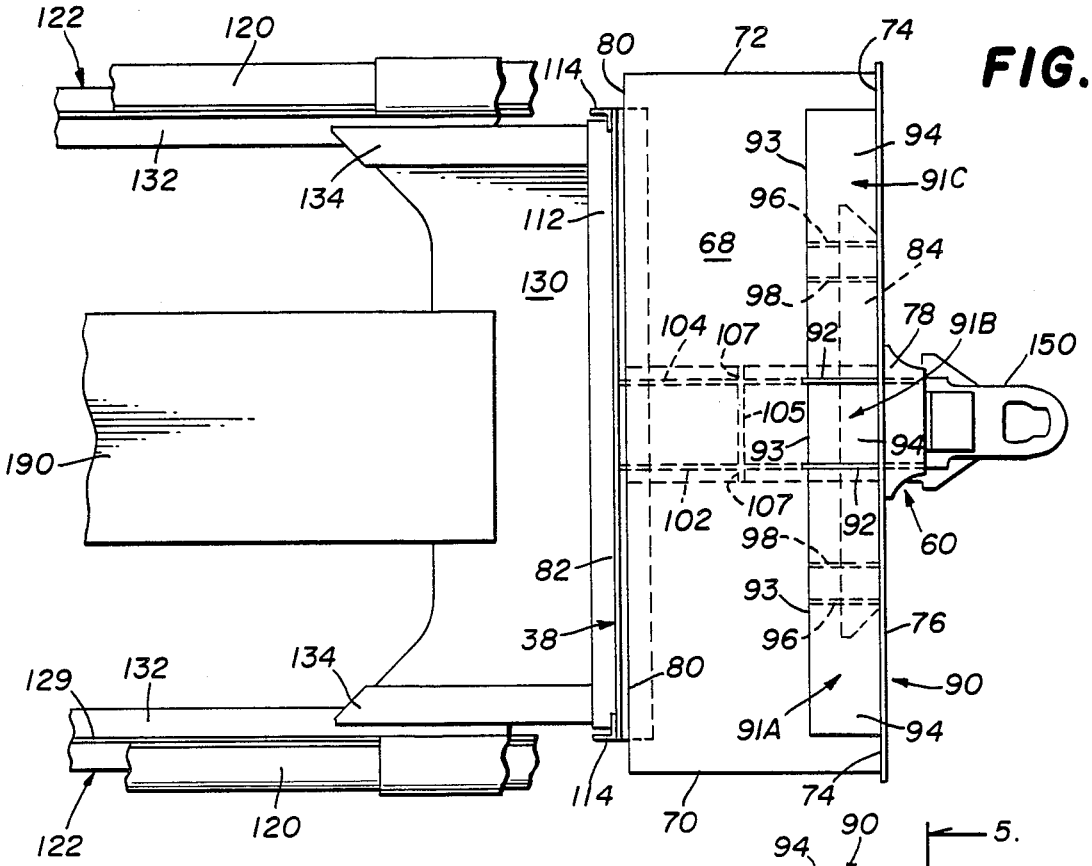
FIG. 3 is a plan view, partially broken away, of one end of the car shown in FIGS. 1 and 2.
Figure 4:
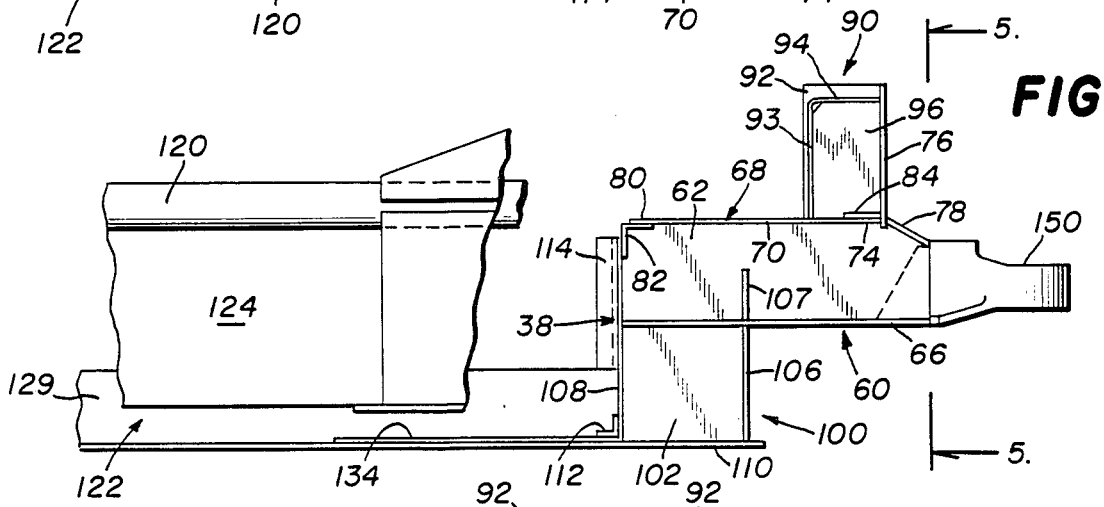
FIG. 4 is a side elevational view, partially broken away, of the car end shown in FIG. 3.
Figure 5:
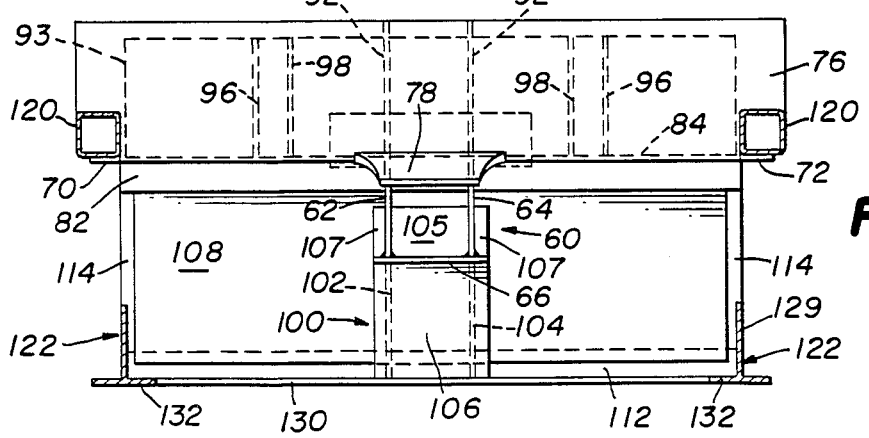
FIG. 5 is a sectional view taken along the line 5—5 of FIG. 4.

The male coupler 150, and the female coupler 152, at the ends of the car body 24 are mounted in a stub sill 60 (FIGS. 3 to 5). Each stub sill 60 includes a pair of spaced apart vertical plates 62, 64, a bottom plate 66 and a top plate which is integral with shear plate 68. Shear plate 68 extends laterally for the width of the car body and the ends 70, 72 of the shear plate are joined to the bottom surface of the top side sills 120. The forward or outer edge 74 of shear plate 68 is joined to vertical plate 76 constituting the forward face of end sill 90. Sloping plate 78 forms part of the stub sill 60 and extends downwardly from the end sill plate 76 to the top of a coupler 150 which is shown as a male coupler but which can be a female coupler. The inner lateral edge 80 of shear plate 68 is joined to the top of the horizontal flange of structural angle member 82 which reinforces the top of well end wall 38. A lateral metal strip 84 is joined to the top of shear plate edge 74 to provide reinforcement.

The end sill 90 is a formed piece. It includes three aligned angle sections 91A, 91B and 91C (FIG. 3) These sections are separated by two vertical plates 92 to which the abutting ends of the angle sections 91A–C are joined. Each angle section 91A–C has a vertical rear plate 93 and a horizontal top plate 94. The front of end sill 90 has a vertical plate 76 which is joined to plate 94 and shear plate 68. The ends of end sill 90 are joined to top side sills 120. The end sill 90 is reinforced by spaced apart internally located vertical plates 96, 98 which are joined to plate 76 and, shear plate 68 and reinforcing strip 84.

Vertically positioned transition box 100 extends downwardly from the bottom of stub sill 60 and is located along the outer surface of end wall 38, or end wall 36 for the other end of the car. The vertical transition box and the center sill have substantially the same width (FIGS. 3 and 5). Transition box 100 has a pair of vertical spaced apart side plates 102, 104 and a forward vertical plate 106 which is laterally located relative to the car body. Forward plate 106 is joined to the forward front edges of plates 102, 104 and the top edges of plates 102, 104, 106 are joined to stub sill bottom plate 66. Directly above plate 106, but inside of stub sill 60, is positioned a vertical plate 105. Vertical braces 107 are joined to the sides of stub sill side plates 62, 64 above plate 106. The vertical inner edges of plates 102, 104 are joined to vertical plate 108 comprising part of well end wall 38. The bottom of transition member 100 is closed by horizontal plate 110, which is joined to the bottom of vertical plates 102, 104 and 106. The horizontal plate 110 can be integral with shear plate 130 subsequently described.

The structural angle member 82 is joined to the top side edge portion of well end plate 108 and structural angle member 112 is joined to the bottom side edge portion of said plate 108. The ends of angle member 112 are connected to side sills 122. The vertical corners of well end wall 38 are reinforced by vertical angle members 114.

Each of the car body side walls 26, 28 has a longitudinal square tubular top side sill 120 and an inverted T-shaped bottom side sill 122. The bottom side sill 122 extends for the length of the well between end walls 36, 38 and the top side sills extend for the full distance between the end sills 90 which are connected thereto. Each side wall 26, 28 includes a vertical plate 124 having its longitudinal top side edge portion 126 joined to the inner side of top side sill 120. The longitudinal bottom side edge portion 128 is joined to the outer surface of the vertical stem or leg 129 of the inverted T-member 122.

A shear plate 130 is positioned laterally in the car well and the opposing edges of the plate are joined to the outer edge of flange 132 of each inverted T-member side sill 122. The joints between the side sills and shear plate are covered by elongated plates 134. The lateral outer edge of shear plate 130 is joined at the bottom of angle member 112.

Two spaced apart identical lateral floor braces 135, 136 are positioned so that one brace is located about one-third of the car body length from a respective body end (FIG. 2). Each brace includes a strip plate 138 which has an upwardly facing channel member joined to the bottom thereof for reinforcement. The ends of the strip plate 138 are joined to transition members 140 extending outwardly from flange 132 of the inverted T-member bottom side sill 122.

Figure 7:
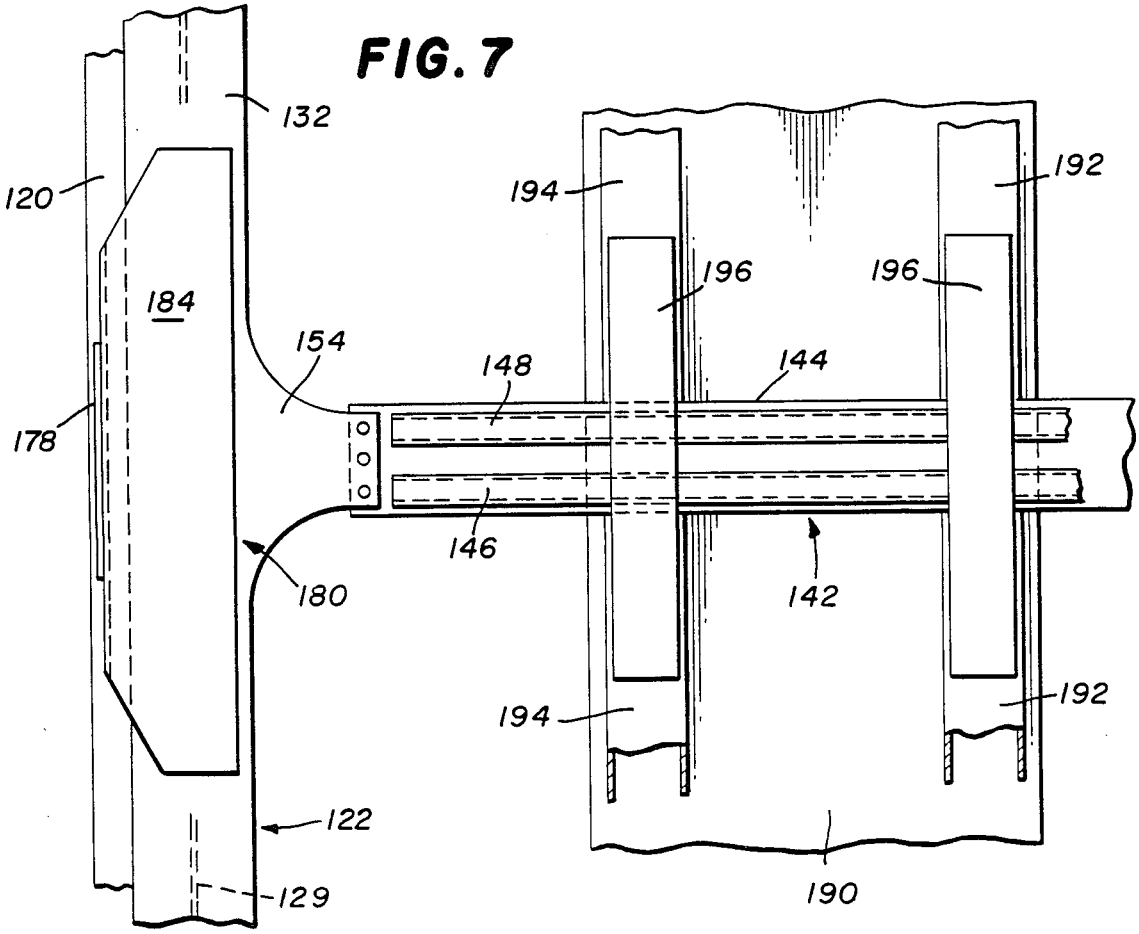
FIG. 7 is a bottom or upwardly looking view of part of the longitudinal central portion of the car as shown in FIG. 2.
Figure 8:
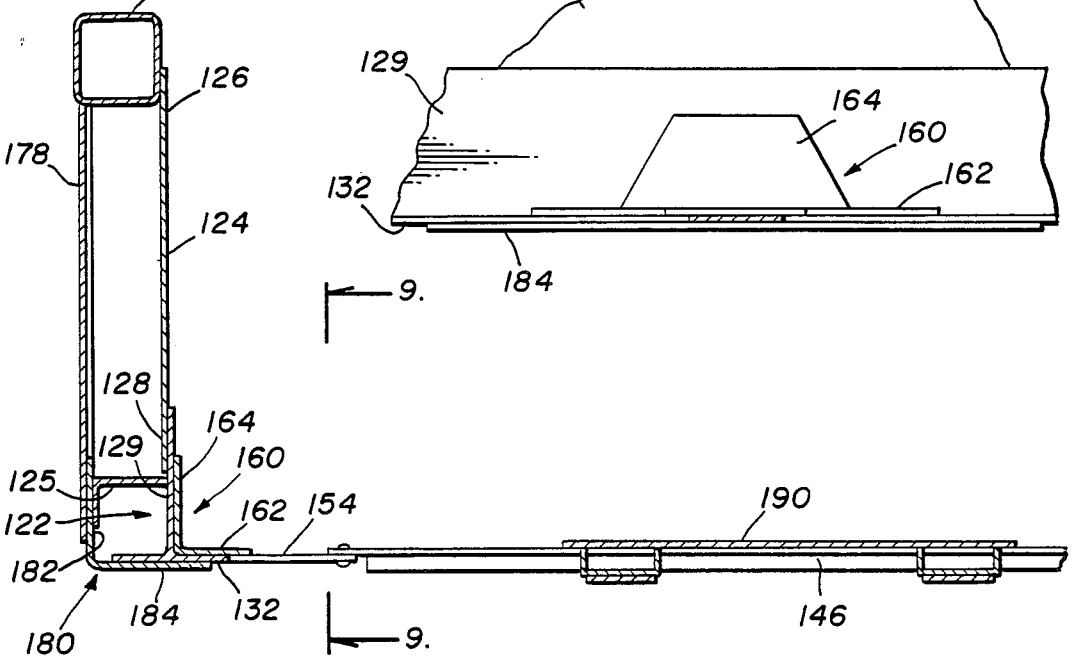
FIG. 8 is a sectional view taken along the line 8—8 of FIG. 6.

A lateral floor brace 142 is centrally located in the car well. Brace 142 includes a strip plate 144 which has a pair of upwardly facing parallel channel members 146, 148 joined to the bottom thereof for reinforcement (FIGS. 7 and 8). The ends of strip plate 144 are connected to transition members 154 which are joined to the edge of flange 132 of bottom side sill 122.

Figure 6:
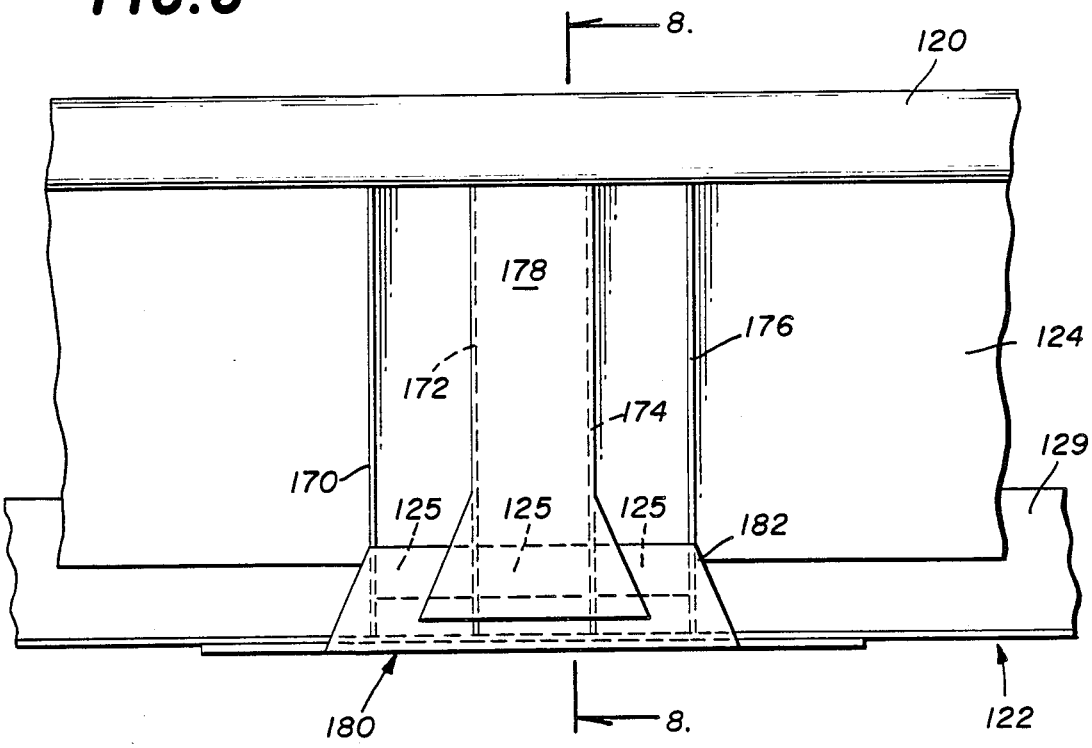
FIG. 6 is a side elevational view of the central portion of the car as shown in FIG. 1.
Figure 9:
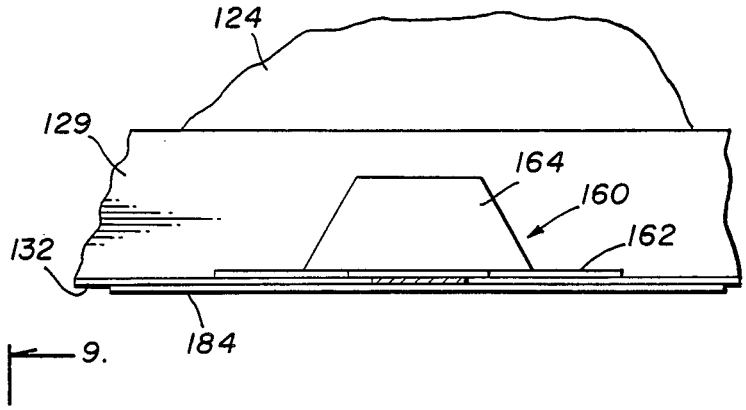
FIG. 9 is a sectional view taken along the line 9—9 of FIG. 8.
Figure 10:
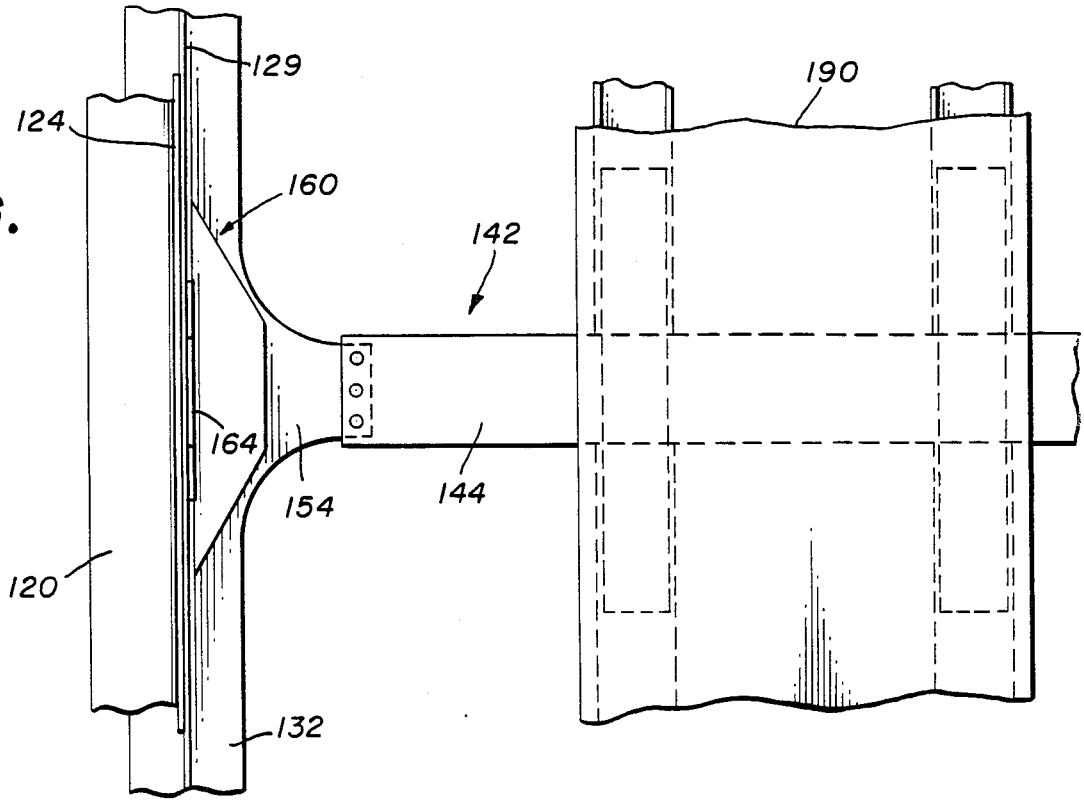
FIG. 10 is a plan view of part of the longitudinal central portion of the car as shown in FIG. 2.

The car body side walls 26, 28 are centrally reinforced to handle the increased load applied to the center of the car body when two short containers, i.e. twenty-feet long containers, are placed end-to-end in the well. Such reinforcements are placed in the side walls adjacent the central lateral brace 142. As shown in FIGS. 8 to 10, a reinforcing angle member 160 is positioned centrally in the body well with one horizontal flange 162 joined to bottom side sill flange 132 and vertical flange 164 joined to the leg or stem 129 of the bottom side sill 122. The central portion of side walls 26, 28 is further reinforced by four external vertical plates 170, 172, 174, 176 positioned normal to and joined to side wall plate 124 (FIG. 6). Horizontal reinforcement angles 125 are placed between and near the bottom of vertical plates 170, 172, 174 and 176 (FIGS. 6 and 8). A vertical plate 178 is connected to the outer edges of plates 172, 174 and to the vertical flange 182 of angle member 180. The horizontal flange 184 of angle member 180 is joined at the lower surface of the bottom side sill 122. The angles 125, angle member 180 and side sill 122 will be seen to complete a box section structure thereby providing excellent strength.

Extending for substantially the full length of the car body well and constituting a major portion of the well floor structure is longitudinal horizontal plate 190 positioned along the center line of the car body. Plate 190 is supported at the ends by, and is joined to, the top of the shear plates 130 at each end of the well. Plate 190 is also supported by and is joined to the top of lateral braces 134, 142 and 136.

The longitudinal horizontal plate 190 is reinforced by upwardly facing spaced apart parallel channel sections 192, 194. These channel sections are located between each shear plate 130 and adjacent lateral brace 134 and between each brace 134 and the central brace 142. A strip plate 196 (FIG. 7) is connected to the bottom of adjacent end portions of the channel sections 192, 194 beneath the braces 135, 136 and 142 and is also joined to those braces.

The described car body is noteworthy for its relatively light weight when empty compared to its carrying load. Equally important as its strength is its relatively ease of fabrication.

Especially important is the use of the transition box 100 to transfer draft and buff forces from the stub center sill 60 to shear plate 130 and plate 190 and to the top and bottom side sills 120, 122. The transition box 100 is readily fabricated and installed in producing the car body. It eliminates the previously used angled structure which took more space and was more costly and difficult to fabricate and install.

The use of inverted T-shaped members for the bottom side sills also facilitates fabrication of the car body while providing high strength in transferring buff and draft loads through the car body. The inverted T-shaped member provides horizontal flanges to which the lateral floor braces and end shear plates 130 are readily joined. The inner flange of the bottom side sill also provides a potential support if a container should break or rupture.

The shear plates 130 at the bottom of each well end also facilitates transfer of draft and buff forces through the car body side walls 26, 28. Also important in the transfer of such forces is the longitudinal center plate 190 extending along the bottom of the well portion from one shear plate 130 at one end of the well to the shear plate 130 at the other end of the well. Plate 190 is also a primary carrying member for the lateral load of twenty-feet containers.

Reinforcement of the central portions of the side walls 26, 28 also makes it possible to carry two containers end-to-end in the well portion without overloading the design strength of the car body. When a single long container is transported in the well only the four lower corners of the container contact the well floor so that one-half of the container load is applied to each end of the well. When two short containers, i.e., twenty foot containers, are placed in a forty foot long well the abutting ends of the containers apply their load to the central portion of the well so that one-half of the load of each equally and uniformly loaded container is applied to the car body central portion. Because of the increased load, the well central portion is reinforced. While the car body embodiment illustrated by the drawings employs several novel structural features for such central reinforcement, it is feasible to use only one or more of such features in a particular car body and, if necessary, to use other structural elements if appropriate.

Another important feature of the car body is the provision of end sills 76 with smooth vertical straight surfaces because such a structure permits the side bearing arms 496 to be readily adjusted as to position on the vertical surface of end sills 76 so as to be accurately joined thereto. Thus, the side bearing arms 496 can be moved up or down or sideways to optimum position before being welded to the surfaces end sill of 76. This permits accurate centering of the arms over the side bearings on the truck bolster and the application of the desired amount of pressure on constant contact side bearing frictional surfaces.

The foregoing detailed description has been given for clearness of understanding only, and no unnecessary limitations should be understood therefrom, as modifications will be obvious to those skilled in the art.

What is claimed is:

1. A railroad car for transporting a horizontal shipping container comprising:

first and second railroad trucks supporting opposite ends of a railroad car body;

the car body having a well portion, defined in part by low longitudinal side walls and lateral end walls, which supports one or more horizontal longitudinally positioned containers;

a center sill at each end of the car body;

each center sill being joined at one end to an upper portion of an adjacent well end wall with the other end of the center sill having coupler means to couple the car to another car to make up a train;

a vertical transition box extending downwardly outside of the well portion along the lateral end wall from the center sill bottom to about the bottom of the well portion;

the vertical transition box and the center sill having substantially the same width; and the well side walls having top and bottom side sills extending at least for the length of the well portion.

2. A railroad car for transporting a horizontal shipping container comprising:

first and second railroad trucks supporting opposite ends of a railroad car body;

the car body having a well portion, defined in part by low longitudinal side walls and lateral end walls, which supports one or more horizontal longitudinally positioned containers;

the well side walls having top and bottom side sills extending at least for the length of the well portion;

a lateral shear plate at the bottom of and in the well portion along each end wall and connected to each bottom side sill; and a longitudinally positioned centrally located horizontal solid plate extending along the bottom of the well portion joined at each end to the lateral shear plate at the end of the well portion.

3. A railroad car for transporting a horizontal shipping container comprising:

first and second railroad trucks supporting opposite ends of a railroad car body;

the car body having a well portion, defined in part by low longitudinal side walls and lateral end walls, which supports horizontal longitudinally positioned containers;

the well portion being sized to receive and transport two containers positioned to abut end-to-end;

a center sill at each end of the car body;

each center sill being joined at one end to an upper portion of an adjacent well end wall with the other end of the center sill having coupler means to couple the car to another car to make up a train;

a vertical transition box extending downwardly outside of the well portion along the lateral end wall from the center sill bottom to about the bottom of the well portion;

the well side walls having top and bottom side sills extending at least for the length of the well portion;

each bottom side sill comprising an inverted T-shaped member; and an angle member being positioned in the well portion nesting with and joined to the corner formed by the web and flange of the inverted T-member, where the adjacent ends of the two containers abut each other.

4. A railroad car for transporting a horizontal shipping container comprising:

first and second railroad trucks supporting opposite ends of a railroad car body;

the car body having a well portion, defined in part by low longitudinal side walls and lateral end walls, which supports one or more horizontal longitudinally positioned containers;

the well side walls having top and bottom side sills extending at least for the length of the well portion;

each bottom side sill comprising an inverted T-shaped member separate from but joined to the side wall and a plurality of lateral cross braces extending between and joined to the bottom side sills;

each well portion side wall being provided with a plurality of vertical ribs on the outside of the side wall central of the well length; and a horizontal flange of a second angle member being joined to the bottom of the inverted T-member outer flange and a vertical flange of the angle member being joined to at least one vertical rib.

5. A railroad car according to claim 1 including a lateral shear plate at the bottom of and in the well portion along each end wall and connected to each bottom side sill.

6. A railroad car according to claim 5 in which:

each top side sill extends beyond the end of the well portion to the end of the car body;

an end sill is at each end of the car body joined to the ends of the top side sills and a shear plate is positioned on top of and joined to each center sill, end sill, the top side sills and the well portion end wall.

7. A railroad car according to claim 1 in which each well portion end wall is reinforced with a flanged structural member extending between and joined to the bottom side sills.

8. A railroad car according to claim 7 in which the top of each well portion end wall is reinforced with a flanged structural member extending between and joined to the top side sills.

9. A railroad car according to claim 6 in which at least one end sill has an outer vertical lateral surface and two side bearing arms are joined to the end sill vertical surface.

10. A railroad car according to claim 1 including a longitudinally positioned centrally located horizontal plate extending along the bottom of the well portion and joined at each end to a lateral shear plate at the bottom of and in the well portion.

11. A railroad car according to claim 10 in which each well portion end wall is reinforced with a flanged structural member extending between and joined to the bottom side sills and which is joined to the shear plate.

12. A railroad car according to claim 3 in which:

each well portion side wall is provided with a plurality of vertical ribs on the outside of the side wall central of the well length; and a second angle member has a horizontal flange joined to the bottom of the inverted T-member outer flange and a vertical flange joined to at least one vertical rib.

13. A railroad car according to claim 12 in which a vertical plate is joined to two centrally located ribs and the plate extends from and is joined to the top side sill and to the second angle member.

14. A railroad car according to claim 1 in which the transition box is essentially rectangular in lateral section.

15. A railroad car according to claim 14 in which the center sill is essentially rectangular in vertical section.

16. A railroad car according to claim 15 in which each end of the car body has a vertically projecting bulkhead structure which includes a lateral bulkhead end wall extending the width of the car body and a pair of opposing relatively short bulkhead side walls extending longitudinally inwardly from the bulkhead end wall along the sides of the car body.

17. A railroad car according to claim 16 in which each bulkhead side wall of a pair of such walls has a container restraining member mounted on an axle for rotation about a substantially vertical axis from a stored position where it does not reduce the clearance between opposing bulkhead side walls to an operating position where it at least projects laterally inwardly of the bulkhead wall to be positioned adjacent a vertical end corner of a top container.

18. A railroad car according to claim 4 including a lateral shear plate at the bottom of and in the well portion along each end wall and connected to each bottom sill.

19. A railroad car according to claim 4 in which:

each top side sill extends beyond the end of the well portion to the end of the car body;

an end sill is at each end of the car body joined to the ends of the top side sills;

the end sill has an outer vertical lateral surface; and two side bearing arms are joined to the end sill vertical surface.

20. A railroad car according to claim 4 in which a vertical plate is joined to two centrally located ribs and the plate extends from and is joined to the top side sill and to the second angle member.

* * * * *

UNITED STATES PATENT AND TRADEMARK OFFICE

CERTIFICATE OF CORRECTION

PATENT NO. : 4,862,810

DATED : September 5, 1989

INVENTOR(S) : RICHARD E. JAMROZY ET AL

It is certified that error appears in the above-identified patent and that said Letters Patent is hereby corrected as shown below:

Column 7, line 30, change "surface" to -- surfaces --; line 33, before "end" insert -- of --; after "sill" delete "of"; column 9, line 4, after "sills" insert -- ; --.

Signed and Sealed this

Twenty-third Day of March, 1993

*Attest:*

STEPHEN G. KUNIN

*Attesting Officer*

*Acting Commissioner of Patents and Trademarks*